US008020415B2

(12) United States Patent
Corbin et al.

(10) Patent No.: US 8,020,415 B2
(45) Date of Patent: Sep. 20, 2011

(54) LOCKING PILL BOTTLE

(75) Inventors: Stampp W. Corbin, San Diego, CA (US); Eric A. Warner, Oceanside, CA (US)

(73) Assignee: Stampp W. Corbin, San Diego, CA (US)

( * ) Notice: Subject to any disclaimer, the term of this patent is extended or adjusted under 35 U.S.C. 154(b) by 277 days.

(21) Appl. No.: 12/478,057

(22) Filed: Jun. 4, 2009

(65) Prior Publication Data

US 2010/0307208 A1 Dec. 9, 2010

(51) Int. Cl.
*E05B 37/02* (2006.01)

(52) U.S. Cl. ..... 70/63; 70/168; 70/312; 70/317; 70/318; 70/319; 70/323; 70/329

(58) Field of Classification Search ..... 70/63, DIG. 23, 70/DIG. 25, 307, 312, 315–319, 323–329, 70/158, 161–163, 166–173
See application file for complete search history.

(56) References Cited

U.S. PATENT DOCUMENTS

| | | | | |
|---|---|---|---|---|
| 446,657 | A | 2/1891 | Baum | |
| 841,668 | A | 1/1907 | Cowles | |
| 3,033,406 | A | 5/1962 | Sauber | |
| 3,129,834 | A | 4/1964 | Kimball | |
| 3,204,436 | A * | 9/1965 | Nemsky | 70/63 |
| 3,405,828 | A | 10/1968 | Pierre | |
| 3,407,954 | A | 10/1968 | Millis | |
| 3,421,347 | A | 1/1969 | Sotory | |
| 3,445,021 | A | 5/1969 | Johnson | |
| 3,669,296 | A | 6/1972 | Drew et al. | |
| 3,684,117 | A | 8/1972 | Leopoldi et al. | |
| 3,843,007 | A | 10/1974 | Meyer | |
| 3,850,324 | A | 11/1974 | Meyer | |
| 4,615,191 | A * | 10/1986 | Grandy | 70/26 |
| 4,644,767 | A * | 2/1987 | Dueringer | 70/312 |
| 5,125,248 | A * | 6/1992 | Ling | 70/25 |
| 5,277,325 | A | 1/1994 | Yan | |
| 5,284,262 | A | 2/1994 | O'Nan | |
| 5,317,796 | A | 6/1994 | Hunter | |
| 5,653,136 | A * | 8/1997 | Huang | 70/312 |
| 5,899,102 | A * | 5/1999 | Ling | 70/312 |
| 6,386,005 | B1 * | 5/2002 | Kuo | 70/28 |
| 6,523,373 | B1 * | 2/2003 | Su | 70/58 |
| 6,880,371 | B2 * | 4/2005 | Huang | 70/28 |
| 7,252,204 | B1 | 8/2007 | Small | |

* cited by examiner

*Primary Examiner* — Lloyd Gall
(74) *Attorney, Agent, or Firm* — Jason H. Foster; Kremblas & Foster

(57) ABSTRACT

A tamper-resistant pill bottle for securely storing a quantity of medication. The pill bottle includes a receptacle, a cap for fitting over the receptacle, and a combination lock integral with the cap for releasably locking the cap to the receptacle. The combination lock includes a series of combination wheels that partially protrude through a sidewall of the cap and can be rotatably manipulated by a user. The combination for the combination lock can be set by a user upon receipt of the pill bottle. The pill bottle further includes an inconspicuous defeat mechanism integral with the cap for allowing the pill bottle to be opened, preferably by a pharmacist, if a user forgets the combination of the combination lock.

15 Claims, 7 Drawing Sheets

LOCKING PILL BOTTLE

BACKGROUND OF THE INVENTION

1. Field of the Invention

This invention relates generally to receptacles for holding medications and more particularly to a tamper-resistant, tamper-evident pill bottle with an integrated combination lock and a method for using the same.

2. Description of the Related Art

Over the past several decades and over the last several years in particular, the incidence of prescription drug abuse has increased at an alarming rate. It has become a regular occurrence for young people to steal prescription medications such as pain relievers, stimulants, and sedatives from family members and to subsequently distribute and abuse such medications for pecuniary gain, recreational use, and for perceived benefits such as weight loss or improved brain function. It is commonly believed by those who engage in such activities that prescription medications are safer than illicit drugs because they are regulated by the government and are dispensed by pharmacies. In reality, prescription medications can be, and often are, addictive, physically harmful, and even deadly when abused by individuals who come into possession of such medications without an appropriate prescription.

One factor that has contributed to the rise of prescription drug abuse is ease of accessibility. Surreptitiously acquiring prescription medications typically requires no more effort than locating a pill bottle in the medicine cabinet of a friend or a family member. If there is a significant quantity of medication left in a particular bottle, it can be very easy for a perpetrator to remove several pills from the bottle without arousing the suspicion of the owner, who will generally not notice the missing quantity. It would therefore be advantageous to have a means for effectively deterring the theft of prescription medications. It would further be advantageous to have a means for making the theft of prescription medications evident to the owners of such medications.

BRIEF SUMMARY OF THE INVENTION

In accordance with the present invention, there is provided an adult tamper-resistant pill bottle, also referred to as a "tamper evident pill bottle", having a receptacle for holding a quantity of medication, a cap for fitting over the receptacle, and a combination lock integral with the cap for releasably locking the cap to the receptacle. The combination lock includes a series of combination wheels that partially protrude through a sidewall of the cap and can be manipulated by a user.

Each combination wheel is defined by an annular outer ring that radially surrounds a substantially circular inner ring. A plurality of circumferentially spaced combination indicia, and preferably indicia representing the integers 0-9, are marked on a radially outwardly-facing surface of each outer ring. A plurality of circumferentially spaced grooves are formed in the radially inwardly-facing surface of each outer ring. The inner ring of each combination wheel has at least one tooth extending radially outwardly therefrom that is radially movable between a retracted position, in which the one tooth cannot radially engage a groove in the outer ring, and an extended position, in which the tooth can radially engage a groove of the outer ring. When the tooth is in the retracted position, the outer ring can be rotated relative to the inner ring. When the tooth is in the extended position and is in radial engagement with a groove in the outer ring, the outer ring is prevented from being rotated relative to the inner ring. Each inner ring further includes a key channel extending axially therethrough having a central shaft portion and a lobe portion extending radially therefrom.

Each inner ring preferably also includes a biasing means, and preferably a pair of flexible serpentines that are integral with the inner ring, for biasing the tooth of the inner ring toward the extended position. An elongated, removable retaining pin extends longitudinally through a pin channel in each of the inner rings and engages a radially-extending detent of each ring for forcibly holding the tooth of each ring in the retracted position. An end of the retaining pin preferably protrudes through a sidewall of the cap. Upon withdrawal of the retaining pin by a user, the teeth of inner rings of the combination wheels are allowed to move to the extended position.

The combination lock of the pill bottle further includes a primary catch that is movable between a locked position, in which the primary catch holds the cap to the receptacle, and an unlocked position, in which the primary catch does not hold the cap to the receptacle. The primary catch is connected to a longitudinally-movable key shaft that extends through the shaft portions of the key channels of the inner rings of the combination wheels. A biasing means, and preferably a conventional coil spring, biases the key shaft and the primary catch toward the locked position. A primary catch button is preferably mounted to the key shaft and protrudes through a sidewall of the cap for engagement by a user. The key shaft has a plurality of key lobes extending radially therefrom. When each of key lobes is longitudinally aligned with a lobe portion of the key channel of an adjacent inner ring, the key lobes can be longitudinally shifted into the lobe portions of the key channels, thus allowing the key shaft and the primary catch to be moved from the locked position to the unlocked position, such as by a user applying force to the primary catch button, and allowing the cap to be removed from the receptacle. If any of the key lobes is not aligned with a lobe portion of its adjacent key channel, the unaligned key lobes are prevented from being shifted into the lobe portions of the key channels, thus preventing the key shaft and the primary catch from being moved from the locked position to the unlocked position and preventing the cap from being removed from the receptacle.

To use the locking pill bottle, a user first receives the locking pill bottle with the teeth of the inner rings of the combination wheels held in their retracted positions by the retaining pin and with the key lobes of the key shaft longitudinally aligned with the lobe portions of the key channels of the inner rings. The user then sets a combination for the integrated lock by rotating the outer rings relative to the inner rings until the indicia representing a desired four digit combination are aligned at the 9 o'clock positions of their respective combination wheels. The user then pulls the retaining pin out of the cap through the pin aperture, thereby allowing each of the teeth to move into radial engagement with a groove in an outer ring, thus locking the rotational movement of each outer ring to the rotational movement of its respective inner ring. Thereafter, the key lobes of the key shaft will be aligned with the lobe portions of the key channels only when combination indicia representing the combination set by the user are rotated to the 9 o'clock position. If any of the indicia representing the correct combination are not at the 9 o'clock position, the key shaft and the primary catch will be prevented from moving longitudinally and the user will not be able to unlock and open the bottle by pressing the primary catch button.

The pill bottle of the present invention preferably also has a defeat mechanism integral with the cap for allowing the pill bottle to be opened if a user forgets the combination of the combination lock. The defeat mechanism includes a defeat catch that is movable between a locked position, in which the defeat catch holds the cap to the receptacle, and an unlocked position, in which the defeat catch does not hold the cap to the receptacle. A biasing means, and preferably a serpentine that is integral with the defeat mechanism, biases the defeat catch toward the locked position. To open the pill bottle, a pharmacist can insert a narrow implement through a small, inconspicuous defeat aperture formed in a sidewall of the cap to engage and forcibly move the defeat catch from the locked position to the unlocked position, thus allowing the pharmacist or the user to remove the cap and access the contents of the receptacle.

Figure 1:
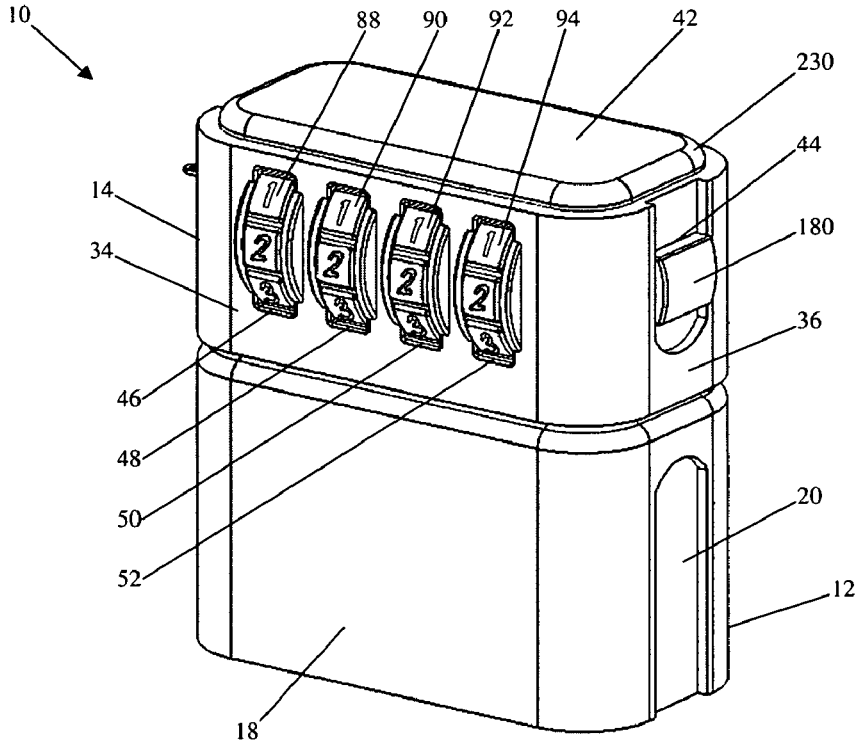
FIG. 1 is a front perspective view illustrating an embodiment of the present invention.

In describing the embodiments of the invention which are illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word "connected" or terms similar thereto are often used. They are not limited to direct connection, but include connection through other elements where such connection is recognized as being equivalent by those skilled in the art.

DETAILED DESCRIPTION OF THE INVENTION

Figure 2:
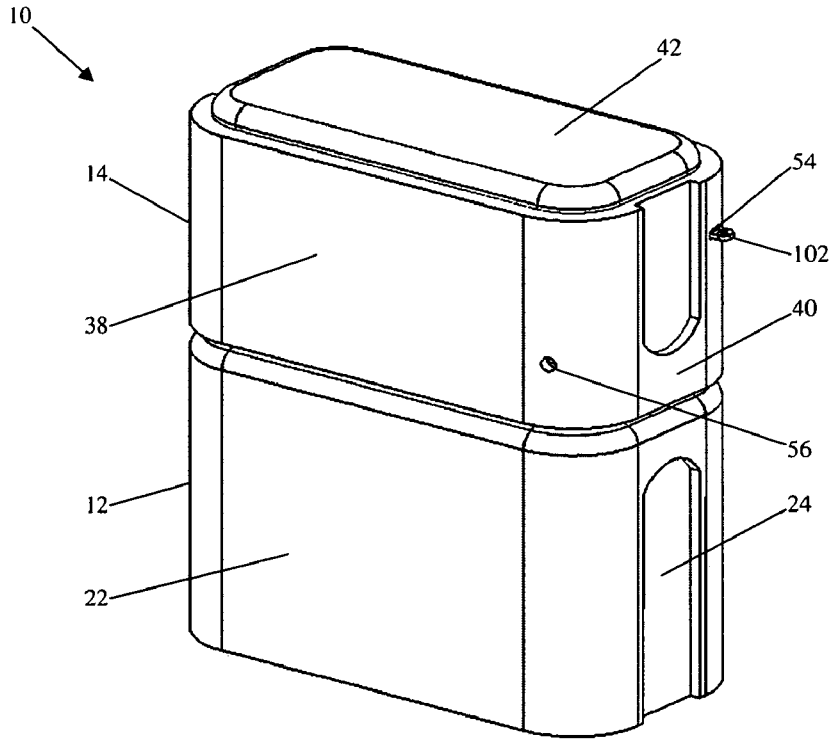
FIG. 2 is a rear perspective view illustrating the embodiment of the present invention shown in FIG. 1.
Figure 3:
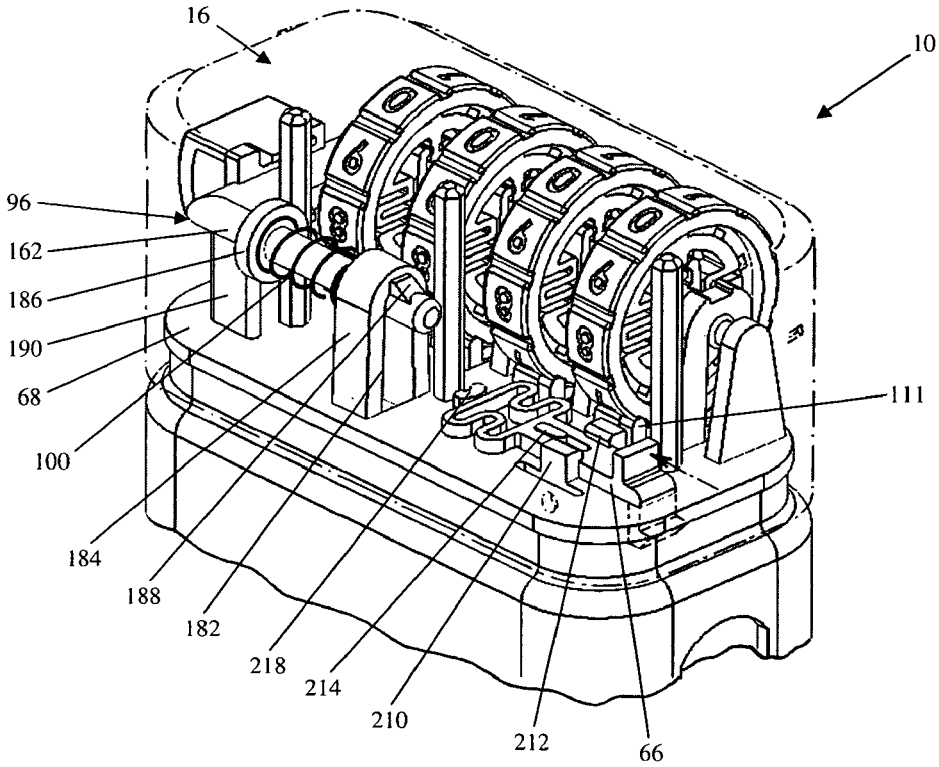
FIG. 3 is a detail view illustrating the integrated lock of the embodiment of the present invention shown in FIG. 1.

Referring to FIGS. 1-3, a tamper evident, locking pill bottle, indicated generally at 10, is shown. The pill bottle includes a receptacle 12, a cap 14, and an integrated lock 16. Unless otherwise noted, all components of the pill bottle 10 are fabricated from a plastic such as Polystyrene (PS), High Density Polyethylene (HDPE), Low Density Polyethylene (LDPE), Polyethylene Terephthalate (PET), Polyvinyl Chloride (PVC), or Polypropylene (PP). Although plastic is preferred, it is contemplated that all other sufficiently rigid, food-grade, and water-impermeable materials, such as aluminum, stainless steel, and Delrin, can be used in fabricating the pill bottle 10. The various components of the pill bottle 10 can be formed by injection molding, casting, blow molding, or similar processes that are well known to those skilled in the art.

For the sake of convenience and clarity, terms such as "front," "rear," "top," "bottom," "up," "down," "inwardly," "outwardly," "lateral," and "longitudinal" will be used herein to describe the relative placement and orientation of components of the invention, each with respect to the geometry and orientation of the pill bottle as it appears in FIG. 1 with the cap 14 mounted to the receptacle 12. Particularly, "front" shall refer to the rightmost longitudinal side of the pill bottle 10 as it appears in FIG. 1, and "rear" shall refer to the leftmost longitudinal side of the pill bottle 10 as it appears in FIG. 1. Said terminology will include the words specifically mentioned, derivatives thereof, and words of similar import.

Figure 11:
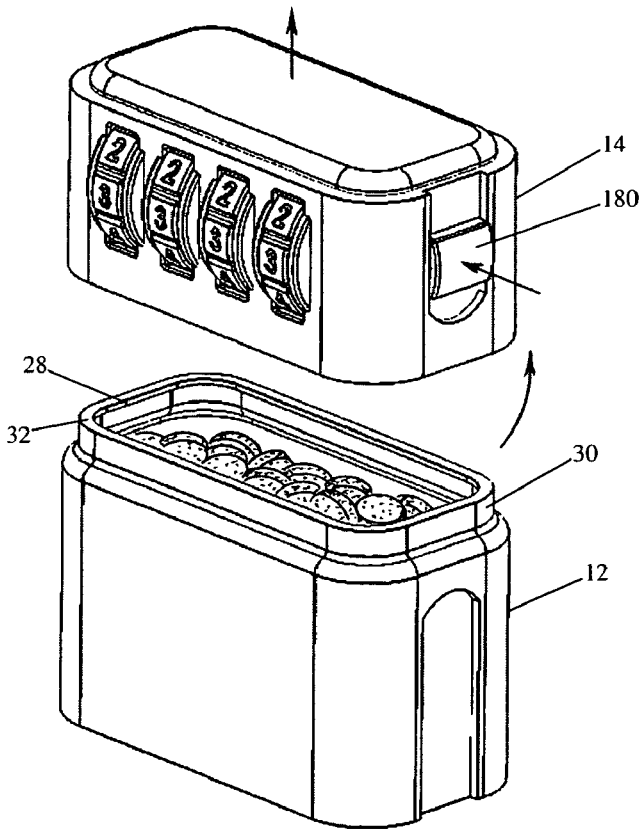
FIG. 11 is a front perspective view illustrating the embodiment of the present invention shown in FIG. 1 with the cap being removed from the receptacle.

Referring to FIGS. 1, 2, and 11, the receptacle 12 of the pill bottle 10 is a generally box-shaped vessel having four sidewalls 18, 20, 22, and 24, a floor 26 (not within view), and an open top 28. The receptacle 12 preferably has rounded edges for comfortable handling. The rounded-rectangular shape of the receptacle 12 is preferred, although it is contemplated that the receptacle 12 can be any suitable shape, such as circular cylindrical, pyramidal, or irregular. A recessed neck 30, defined by four adjoining sidewalls, extends inwardly and upwardly from the top edges of the sidewalls 18-24 for fitting within the cap 14. The retaining flange 32 extends inwardly from the top edges of the recessed neck 30 as best shown in FIG. 11.

Figure 5:
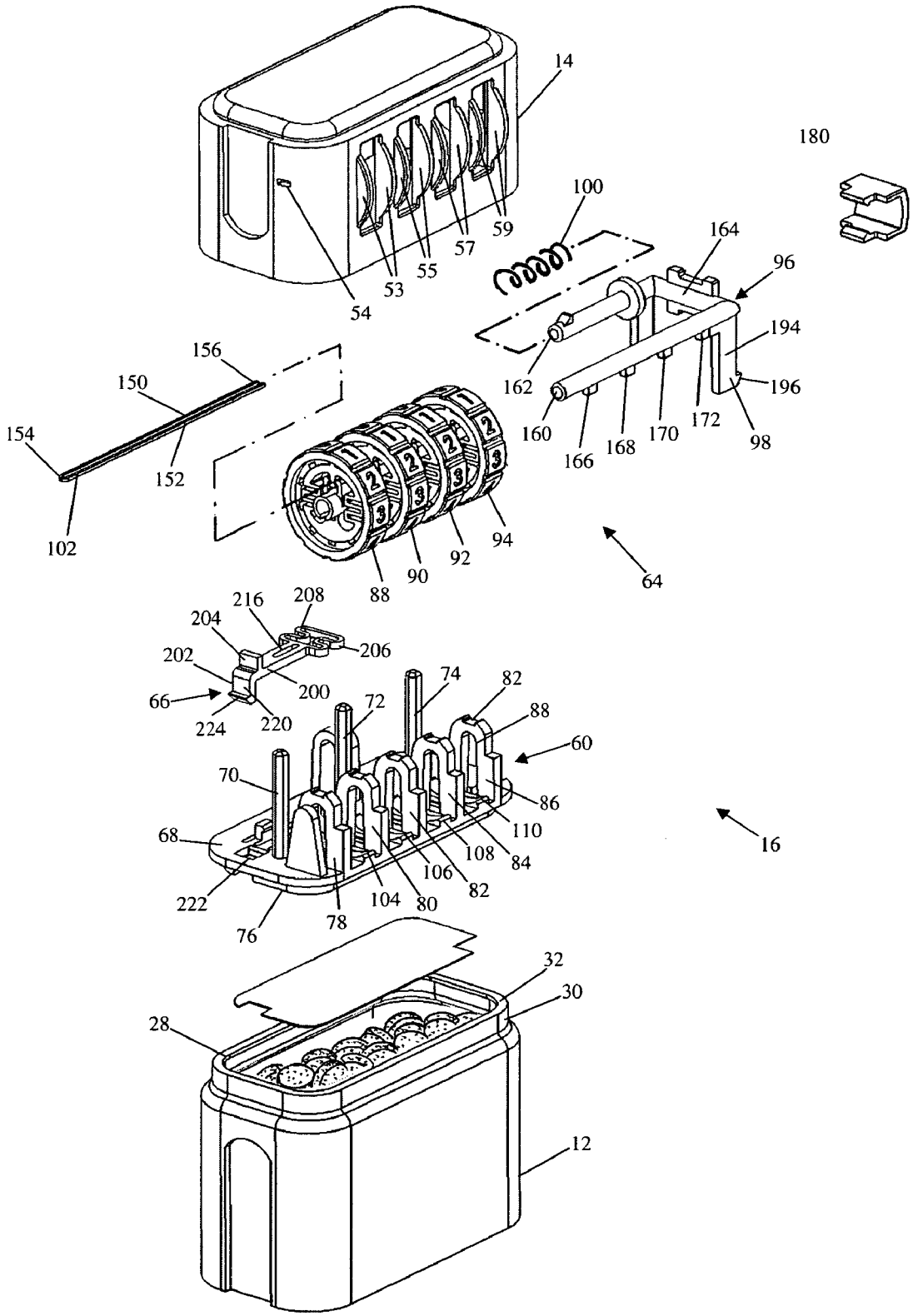
FIG. 5 is an exploded view illustrating the embodiment of the present invention shown in FIG. 1.
Figure 6:
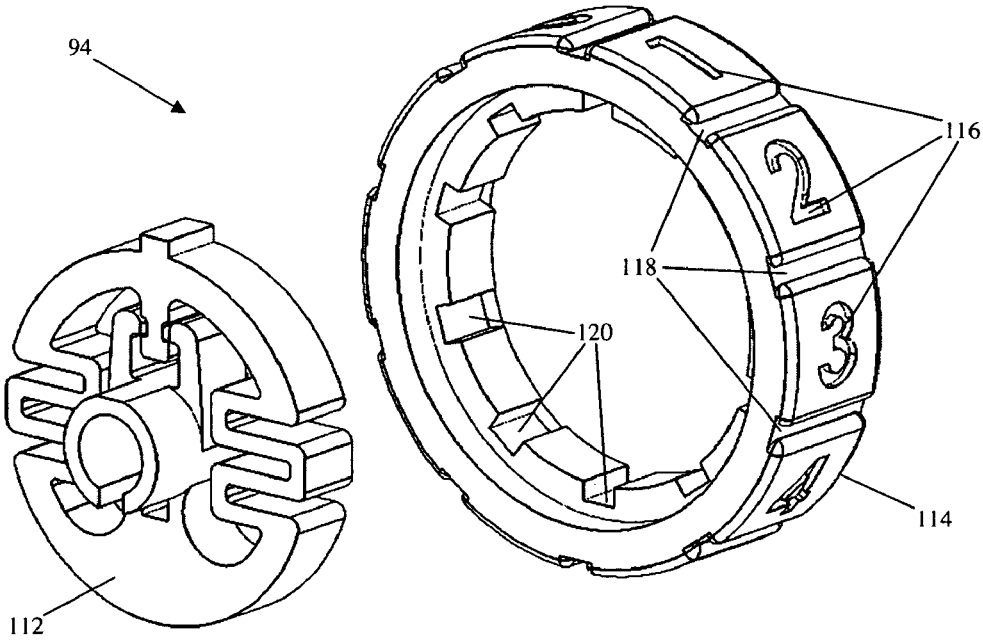
FIG. 6 is an exploded detail view illustrating a combination wheel of the embodiment of the present invention shown in FIG. 1.

Referring to FIGS. 1, 2, and 5, the cap 14 is a generally box-shaped member having four sidewalls 34, 36, 38, and 40, a top wall 42, and an open bottom 44 (not within view). Like the receptacle 12, the cap 14 preferably has rounded edges for comfortable handling. The rounded-rectangular shape of the cap 14 is preferred, although it is contemplated that the cap 14 can be any suitable shape for fitting over the receptacle 12, such as cylindrical, pyramidal, or irregular. The cap 14 has substantially the same length and width as the receptacle 12, and the lower edges of the sidewalls 34-40 define an opening that receives the recessed neck 30 of the receptacle 12 in a laterally and longitudinally close clearance relationship.

The sidewall 36 of the cap 14 has a button aperture 44 formed therethrough for allowing pass-through of the primary catch button 180 of the lock 16 (described below). The sidewall 34 of the cap 14 has a series of wheel apertures 46, 48, 50, 52 formed therethrough in an evenly-spaced, side-by-side relationship for allowing pass-through of the combination wheels 88-94 of the lock 16 (described below). Pairs of rounded flanges 53, 55, 57, and 59 preferably extend from the lateral edges of each of the wheel apertures 46-52 for providing the combination wheels 88-94 of the lock 16 with longitudinal support and for reducing the likelihood of accidental manipulation of the combination wheels 88-94. The sidewall 40 of the cap 14 has a pin aperture 54 formed therethrough for allowing the retaining pin 102 of the lock 16 to be removed from the cap 14 as further described below. The sidewall 38 of the cap 14 has a defeat aperture 56 formed therethrough for allowing insertion of an implement into the cap 14 to manipulate the defeat mechanism 66 of the lock 16 as further described below.

Referring to FIGS. 3 and 5, the integrated lock 16 of the pill bottle 10 includes a base plate, indicated generally at 60, a key mechanism, indicated generally at 64, and a defeat mechanism, indicated generally at 66. The base plate 60 of the lock 16 includes a generally planar floor 68 that has a length, width, and perimeter contour that are substantially similar to the length, width, and perimeter contour of the opening 44 in the cap 14 as defined by the lowermost interior edges of the cap's sidewalls 34-40. The floor 68 is positioned within the cap 14 with the downwardly-facing surface of the floor 68 vertically flush with the bottom edges of the cap sidewalls 34-40 and with the perimeter of the floor 68 in a continuous, close clearance relationship with the interior surfaces of the cap sidewalls 34-40.

Three longitudinally-spaced, cylindrical mounting posts 70, 72, and 74 extend upwardly from the floor 68. A topmost portion of each mounting post fits axially within the central channel of a corresponding mounting cylinder (not within view) that extends downwardly from the top wall 42 of the cap 14. The mounting posts 70-74 are firmly held within the mounting cylinders by frictional engagement between the interior wall of each mounting cylinder and the exterior wall of a corresponding mounting post 70-74. The mounting posts 70-74 and mounting cylinders thereby provide the means by which the entire lock 16 is mounted within the cap 14. It is contemplated that the mounting posts 70-74 can additionally or alternatively be held within the mounting cylinders by other means of secure affixation, such as by snap fit or by conventional adhesives or fasteners. It is further contemplated that the mounting posts 70-74 and the mounting cylinders can be omitted and that the integrated lock 16 can be held within the cap 14 by any other suitable means of affixation, such as those described above.

Still referring to FIGS. 3 and 5, a locating collar 76, defined by four adjoining sidewalls, extends downwardly from the floor 68 of the base plate 60 into the opening 28 of the recessed neck 30 of the receptacle 12. The locating collar 76 has a length, width, and perimeter contour that are substantially similar to the length, width, and perimeter contour of the opening 28 in the top of the receptacle 12 as defined by the inwardly-facing surface of the retaining flange 32. The retaining flange 32 thus surrounds the locating collar 76 with the inwardly-facing surfaces of the retaining flange 32 in a continuous, close clearance relationship with the perimeter of the locating collar 76 when the cap 14 is in place on the receptacle 12 as shown in FIG. 1.

A series of planar support brackets 78, 80, 82, 84, and 86 extend upwardly from the floor 68 in a longitudinally-spaced, parallel configuration. Each support bracket 78-86 is shaped generally like an inverted "U" and has an inner contour that defines a vertically-elongated shaft channel (only the shaft channel 80 of the forward-most support bracket 86 is shown in FIG. 5 and is representative of the shaft channels of the other support brackets 78-84) that is longitudinally aligned with the similar shaft channels of the other support brackets. Each of the support brackets 78-86 also has a pin notch formed in its topmost surface that extends longitudinally across the top of each support bracket (only the pin notch 82 of the forward-most support bracket 86 is shown in FIG. 5 and is representative of the pin notches of the other support brackets 78-84) and that is longitudinally aligned with the similar pin notches in the other support brackets.

The key mechanism 64 of the integrated lock 16 generally includes four combination wheels 88, 90, 92, and 94, a J-shaped drive bar, indicated generally at 96, a primary catch 98, a spring 100, and a retaining pin 102. Each of the combination wheels 88-94 of the key mechanism 64 is positioned between an adjacent pair of the support brackets 78-86 in a generally coaxial relationship with the channel of the pair of support brackets. Each of the combination wheels 88-94 is seated on a respective one of the shelves 104, 106, 108, and 110 that is integral with the floor 68 of the base plate 60 and that has a concave top surface that conforms to the curvature of the radially-outermost surface of the respective combination wheel 88-94 seated thereon. Flexible detent arms 111 extend upwardly from the shelves 104-110 (only the detent arm 111 of the rear-most shelf 104 is indicated in FIG. 3 and is representative of the detent arms of the other shelves 106-110) for engaging the outer rings 114 of the combination wheels 88-94 in a manner that will be described below.

Although the locking pill bottle 10 is provided with four combination wheels 88-94, it is contemplated that there can be as few or as many combination wheels as can be practically implemented. Having a greater number of combination wheels generally reduces the likelihood that one who does not know the correct combination to the key mechanism 64 will be able to open the locking pill bottle 10, as will become apparent below. The combination wheels 88-94 are substantially identical and will now be described with reference to the forward-most combination wheel 94 only.

Figure 4:
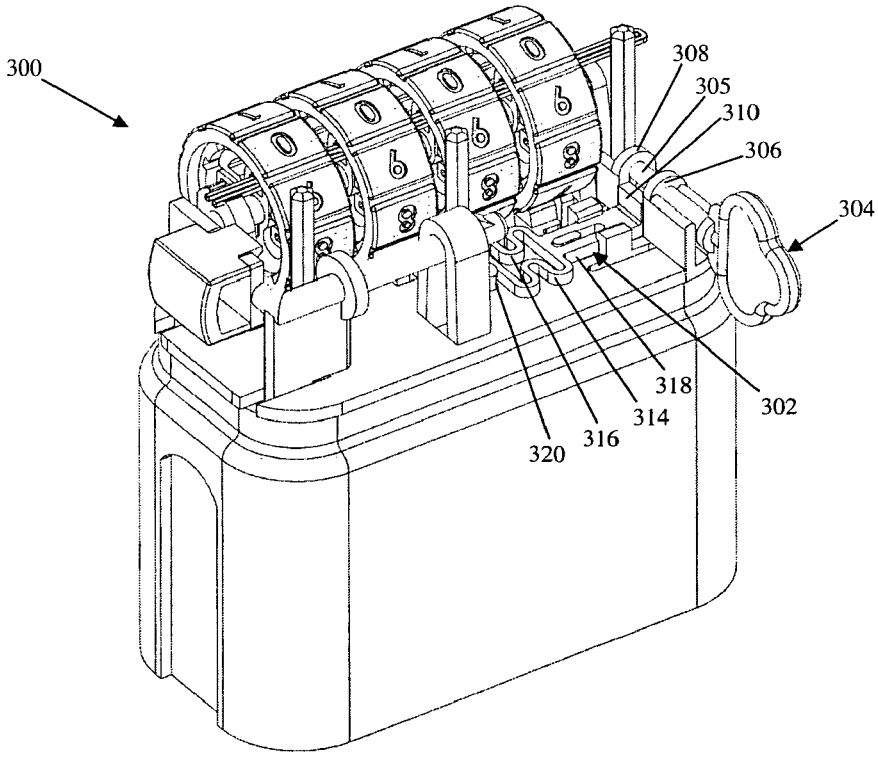
FIG. 4 is a detail view illustrating an alternative embodiment of integrated lock of the present invention.

Referring to FIGS. 5-8, the combination wheel 94 includes an inner ring 112 and an outer ring 114. The outer ring 114 of the combination wheel 94 is generally annular and has a radially-outermost surface that is marked with combination indicia 116. The combination indicia 116 are preferably the integers 0, 1, 2, 3, 4, 5, 6, 7, 8, and 9 as shown in FIG. 4 (the indicia 0 and 5-9 are not within view), although it is contemplated that various other indicia can additionally or alternatively be used, such as letters, roman numerals, Braille symbols and other symbols or pictures. The combination indicia 116 are formed as impressions in the radially-outermost surface of the outer ring 114, although it is contemplated that the combination indicia 116 can be marked on the outer ring 114 in any suitable manner, such as by embossing, painting, or by affixing decals to the outer ring 114. The combination indicia 116 are evenly spaced about the perimeter of the outer ring 114.

Longitudinally-oriented grooves 118 are preferably formed in the radially-outermost surface of the outer ring 114 with each groove positioned circumferentially-intermediate a pair of combination indicia 116 for providing easily identifiable, tactile lines of demarcation that separate the combination indicia 116 from one another. The grooves 118 are also provided for matingly receiving the detent arms 111 of the shelves 104-110 described above. Each detent arm 111 is flexibly held in firm radial engagement with the outer surface of a corresponding outer ring 114 and thus snaps into a groove 118 of the outer ring 114 when the detent arm 111 moves into radially alignment with a groove 118. The engagement between the detent arms 111 and the outer rings 114 thereby provides a palpable "clicking" sensation to a user as the user rotates the combination wheels 94 in a manner that will be described in greater detail below. Preferably, each of the grooves 118 is radially separated from one of the combination indicia 116 by an angle of 90 degrees relative to the axis of the outer ring 114 for reasons that will become apparent below. Longitudinally oriented grooves 120, similar to the grooves 118, are formed in the radially-innermost surface of the outer ring 114, with each groove 120 preferably radially-aligned with one of the grooves 118.

Figure 7:
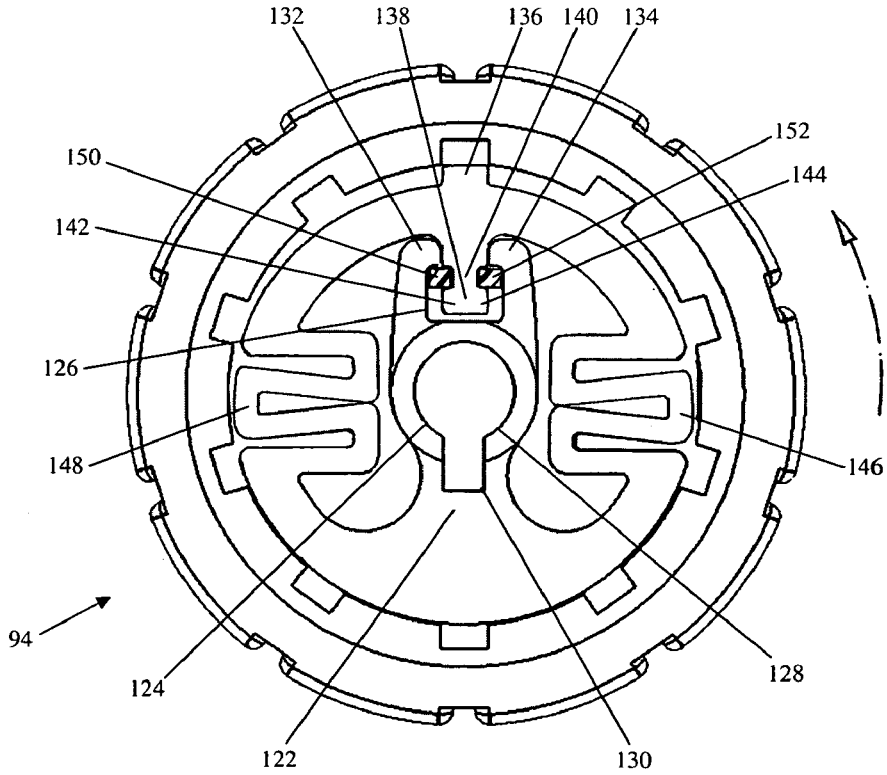
FIG. 7 is front detail view illustrating a combination wheel of the embodiment of the present invention shown in FIG. 1.
Figure 8:
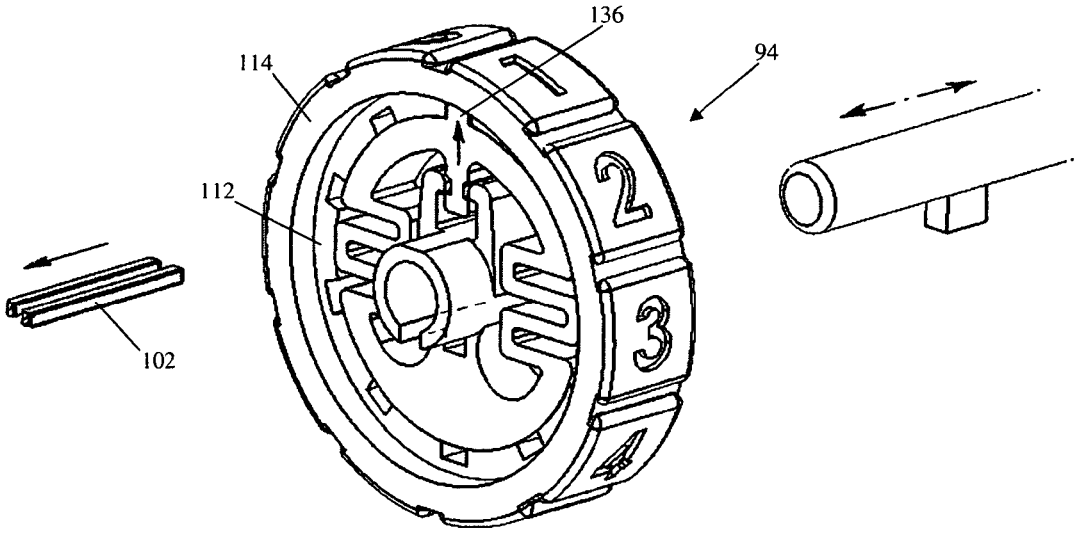
FIG. 8 is an exploded detail view illustrating the key shaft, retaining pin, and a combination wheel of the embodiment of the present invention shown in FIG. 1.

The inner ring 112 of the combination wheel 94 fits axially within the outer ring 114, as shown in FIGS. 7 and 8, and is in a radially close clearance relationship therewith. The inner ring 112 includes a vertically-extending central bracket 122 (FIG. 7) that defines a key channel 124 and a pin channel 126, both of which extend longitudinally through the inner ring 112. The key channel 124 is generally keyhole-shaped with a circular shaft portion 128 and a downwardly-extending lobe portion 130. The pin channel 126 is generally rectangular in shape and has a partially open top that is defined by two laterally-opposing, inwardly-extending claws 132 and 134.

The inner ring 112 further includes a tooth 136 that extends radially-outwardly from the 12 o'clock position of the inner ring 112, and a T-shaped detent 138 that extends radially inwardly from the 12 o'clock position of the inner ring 112. The T-shaped detent 138 is defined by a vertically-extending leg 140 and two laterally-extending arms 142 and 144.

The outer contours of the inner ring 112 define two flexible serpentines 146 and 148 at the 3 o'clock and 9 o'clock positions of the inner ring 112, respectively in the orientation of FIG. 7. The serpentines 146 and 148 act as springs that bias the inner ring 112 toward a vertically-expanded "set" configuration with the T-shaped detent 138 nearer the top of the pin channel 126 and with the tooth 136 in engagement with one of the grooves 120 in the outer ring 114, as shown in FIG. 8. The serpentines 146 and 148 can be forcibly compressed, thus causing the inner ring 112 to be held in a vertically-collapsed "unset" configuration with the T-shaped detent 138 nearer the bottom of the pin channel 126 and with the tooth 136 out of engagement with the grooves 120 of the outer ring 114 (FIG. 7). Although the integrated serpentines 146 and 148 are preferred for biasing the inner ring 112 toward the set configuration, it is contemplated that a variety of other biasing means can be employed, including, but not limited to coil springs, planar springs, or electrical solenoids.

Still referring to FIGS. 4-7, the retaining pin 102 is an elongated, U-shaped member that resembles a conventional hair pin having two parallel arms 150 and 152, a first end 154 that is closed, and a second end 156 that is open. The arms 150 and 152 of the retaining pin 102 are seated within the aligned pin notches 82 of the support brackets 78-86 and extend longitudinally through the aligned pin channels 126 of the inner rings 112 of the combination wheels 88-94. The closed end 154 of the retaining pin 102 protrudes from the pin aperture 54 in the cap 14 (see FIG. 2).

The arms 150 and 152 of the retaining pin 102 laterally sandwich the legs 140 of the T-shaped detents 138 of each of the inner rings 112 and are vertically interposed between the laterally-extending arms 142 and 144 of the T-shaped detents 138 and the inwardly-extending claws 132 and 134 that define the partially open tops of the pin channels 126, as best shown in FIG. 7. The arms 150 and 152 of the retaining pin 102 thereby hold the arms 142 and 144 of the T-shaped detents 138 down, when the inner ring 112 is in the "unset" configuration, near the bottoms of their respective pin channels 126 in opposition to the upwardly-directed spring force exerted by the serpentines 146 and 148. The inner rings 112 of the combination wheels 88-94 are thus forcibly held in their vertically-collapsed, unset configurations by the inserted retaining pin 102 with their respective teeth 138 out of engagement with the grooves 120 of the outer rings 114 as shown in FIG. 7.

With the inner rings 112 held in their unset configurations by the retaining pin 102, the outer rings 114 of the combination wheels 88-94 can be rotated about their respective axes relative to the inner rings 112. Because the laterally-opposing sidewalls of the pin notches 82 prevent the arms of the retaining pin 102 from moving significantly laterally, the T-shaped detents 138 are held in the unset configuration while the laterally opposing sidewalls of the pin channels 126 are kept from moving significantly laterally, which in-turn prevents the inner rings 112 from being rotated by any significant degree relative to the support brackets 78-86. Thus, despite moderate frictional engagement between the inwardly-facing surfaces of the outer rings 114 and the outwardly-facing surfaces of the inner rings 112, the inner rings 112 are held substantially stationary while the outer rings 114 can be rotated.

If the retaining pin 102 is removed from the inner rings 112, such as by pulling the retaining pin 102 longitudinally out of the cap 14 through the pin aperture 54 (see FIG. 9), the T-shaped detents 138 of the inner rings 112 are vertically released, and the serpentines 146 and 148 vertically expand the inner rings 112 to their set positions (see FIG. 8). The teeth 136 of the inner rings 112 thereby move into radial engagement with one of the grooves 120 of the respective outer ring 114, subsequently preventing the outer rings 114 from being rotated relative to the inner rings 112. However, once the retaining pin 102 is removed, both the inner rings 112 and the outer rings 114 can be rotated relative to the support brackets 78-86.

Referring again to FIGS. 3 and 5, the drive bar 96 includes a generally cylindrical key shaft 160 and a generally cylindrical rebound shaft 162 that are parallel to one another and that are interconnected at their forward-most ends by a laterally-extending crossbar 164. The key shaft 160 extends longitudinally through and between the shaft channels of the support brackets 78-86 and through and between the key channels 124 of the combination wheels 88-94. Four key lobes 166, 168, 170, and 172 extend downwardly from the 6 o'clock position of the key shaft 160 in a longitudinally-spaced relationship. Each key lobe 166-172 is positioned longitudinally forward of an adjacent key channel 124 of a combination wheel 88-94 and is longitudinally-aligned with the lobe portion 130 of the inner ring 112 of the adjacent key channel 124. Each key lobe 166-172 has a lateral cross-section with a shape and size that is substantially similar to, but slightly smaller than, the shape and size of the lateral cross-section of the lobe portions 130 of its respective adjacent key channel 124 to permit movement of the key lobes 166-172 through the lobe portions 130.

A primary catch button 180 extends longitudinally-forward from the crossbar 164 of the drive bar 96 and protrudes through the button aperture 44 of the cap 14, as shown in FIG. 1. The primary catch button 180 is rigidly mounted to the crossbar 164 by conventional snap-fitting, although it is contemplated that the primary catch button 180 can be mounted to the crossbar 164 using any suitable means of affixation, such as with conventional fasteners or adhesives. It is further contemplated that the primary catch button 180 can be formed as an integral extension of the drive bar 96.

Still referring to FIGS. 3 and 5, the rebound shaft 162 of the drive bar 96 extends longitudinally through the shaft channel 182 of an inverted U-shaped rebound bracket 184 that extends upwardly from, and is preferably integral with, the floor 68 of the base plate 60. An annular rebound collar 186 extends radially from the rebound shaft 162 at a position longitudinally forward of the rebound bracket 184. A conventional coil spring 100 is mounted on the rebound shaft 162 between the rebound collar 186 and the rebound bracket 184. The spring 100 is held in axial compression between the rebound collar 186 and the rebound bracket 184 and thus biases the drive bar 96 longitudinally away from the rebound bracket 184 and toward a forward-most "locked" position (described in greater detail below). A tooth 188 extends upwardly from the rearward-most end of the rebound shaft 162 for longitudinally engaging the rebound bracket 184 and preventing the spring 100 from moving the rebound shaft 162 forward beyond a predetermined limit. A vertically-elongated support bracket 190 extends downwardly from the forward-most end of the rebound shaft 162 and rests on the floor 68 for providing the rebound shaft 162 with vertical support. By applying a sufficient amount of longitudinally-directed force to the primary catch button 180, a user can overcome the resistance of the spring 100 and longitudinally shift the rebound shaft 162 rearward, thereby moving key lobes 166-172 of the key shaft 160 into the lobe portions 130 of their respective adjacent key channels 124 and moving the drive bar 96 to a rearward-most "unlocked" position (described in greater detail below).

Figure 10:
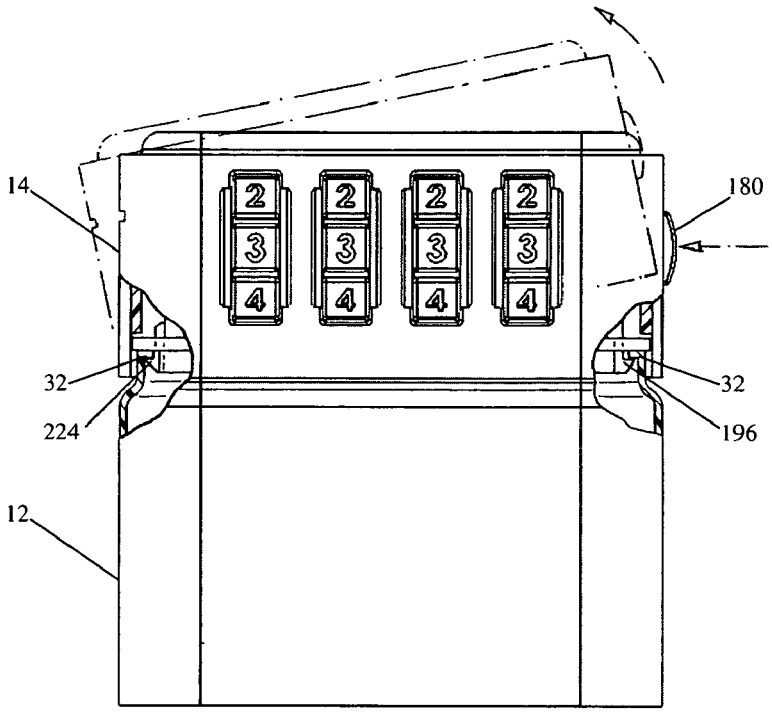
FIG. 10 is a cut-away view illustrating the embodiment of the present invention shown in FIG. 1.

The primary catch 98 is a generally L-shaped member having a vertical leg 194 that extends downwardly from the drive bar 160, through a longitudinally-elongated notch (not within view) in the front edge of the base plate 60, and into the recessed neck 30 of the receptacle 12. The primary catch 98 includes an angled tooth 196 that extends longitudinally forward from a lower end of the vertical leg 194. When the drive bar 96 is in the locked position (described above), the tooth 196 is longitudinally positioned directly below, and is in close vertical proximity to, the downwardly-facing surface of the retaining flange 32 as best shown in FIG. 10. Positioned thusly, the top edge of the tooth 196 is prevented from moving upwardly beyond the lower edge of the retaining flange 32, which in-turn prevents the front side of the cap 14 from being lifted vertically away from the receptacle 12. Thus, when the drive bar 96 is moved in this manner, the cap 14 is removed and the contents of the receptacle 12 are exposed for use.

When the drive bar 96 is moved to the unlocked position, the tooth 196 is positioned longitudinally rearward of the retaining flange 32. With the tooth 196 in such a position, the retaining flange 32 does not impede vertical movement of the tooth 196 and the front side of the cap 14 can therefore be freely lifted away from the receptacle 12.

Still referring to FIGS. 3 and 5, the defeat mechanism 66 of the integrated lock 16 is preferably a unitary structure that includes a slide plate 200, a defeat catch 202, a push tab 204, and a pair of flexible, laterally opposing serpentines 206 and 208. The slide plate 200 of the defeat mechanism 66 is a substantially planar member that rests on the floor 68 of the base plate 60. Laterally-opposing L-shaped brackets 210 and 212 extend from, and are preferably integral with, the floor 68 on either lateral side of the slide plate 200 for preventing vertical and lateral movement of the slide plate 200 while allowing the slide plate 200 to be moved longitudinally along the floor 68. A longitudinally-elongated guide rail 214 preferably extends upwardly from the floor 68, through a longitudinally-elongated aperture 216 in the slide plate 200 for providing the slide plate 200 with additional lateral stability while allowing the slide plate 200 to be moved longitudinally.

A rebound wall 218 extends from, and is preferably integral with, the floor 68 at a position longitudinally forward of the defeat mechanism 66. The serpentines 206 and 208 are longitudinally compressed between the slide plate 200 and the rebound wall 218 and thereby bias the slide plate 200 longitudinally away from the rebound wall 218, toward a rearward-most "locked" position (described in greater detail below). A sufficient amount of longitudinally-directed force can be applied to the slide plate 200, such as by inserting a pin or a similarly narrow implement laterally through the defeat aperture 56 in the cap 14 and using the implement to move the push tab 204 forward. By applying sufficient force, a user (most preferably the pharmacist, who is aware of the defeat aperture's purpose) can overcome the resistance provided by the serpentines 206 and 208 and shift the slide plate 200 longitudinally forward, toward the rebound wall 218 to a forward-most "unlocked" position (described in greater detail below).

The defeat catch 202 is a generally L-shaped member having a vertical leg 220 that extends downwardly from the rear edge of the slide plate 200, through an aperture 222 in the base plate 60, and into the recessed neck 30 of the receptacle 12. The defeat catch 202 includes an angled tooth 224 that extends longitudinally rearward from a lower terminus of the vertical leg 220. When the slide plate 200 is in the locked position (described above), the tooth 224 is longitudinally positioned directly below, and is in close vertical proximity to, the downwardly-facing surface of the retaining flange 32, as best shown in FIG. 10. In this position, the top edge of the tooth 224 is prevented from moving upwardly beyond the lower edge of the retaining flange 32, which in-turn prevents the rear side of the cap 14 from being lifted vertically away from the receptacle 12.

When the slide plate 200 is moved forward to the unlocked position, the tooth 224 is positioned longitudinally forward of the retaining flange 32. With the tooth 224 in such a position, the retaining flange 32 does not impede vertical movement of the tooth 224 and the rear side of the cap 14 can therefore be freely lifted away from the receptacle 12.

When the cap 14 is operatively mounted to the receptacle 12 with the drive bar 96 and the slide plate 200 both in their locked positions (as shown in FIG. 10), the cap 14 is prevented from being manually removed from the receptacle 12 by a human user of average physical strength. However, if either the drive bar 96 or the slide plate 200 is moved to its unlocked position, the cap 14 can be easily removed from the receptacle 12 in the manner described above by pivoting the cap 14 about the tooth that is not retracted from the flange 32.

Referring to FIG. 4, an alternative embodiment of the invention is contemplated in which the locking pill bottle 300 is provided with a defeat mechanism 302 having a proprietary defeat key 304 that can be inserted through a defeat aperture in the lid (not shown) of the locking pill bottle 300 that is similar to, but generally larger than, the defeat aperture 14 described above. When the defeat key 304 is inserted into the lid, the shaft 305 of the defeat key 304 laterally engages a pair of key brackets 306 and 308 and is rotatably held therein. A key tooth (not within view) extends downwardly from the key shaft 304 longitudinally adjacent the push tab 310 of the defeat mechanism 302. By rotating the defeat key 304 clockwise, a user can cause the key tooth to engage the push tab 310. If a sufficient amount of torque is applied to the defeat key 304, the user can overcome the resistance provided by the serpentines 314 and 316 and shift the slide plate 318 longitudinally forward, toward the rebound wall 320 to a forward-most "unlocked" position in a similar manner to that described above for the defeat mechanism 66.

Figure 9:
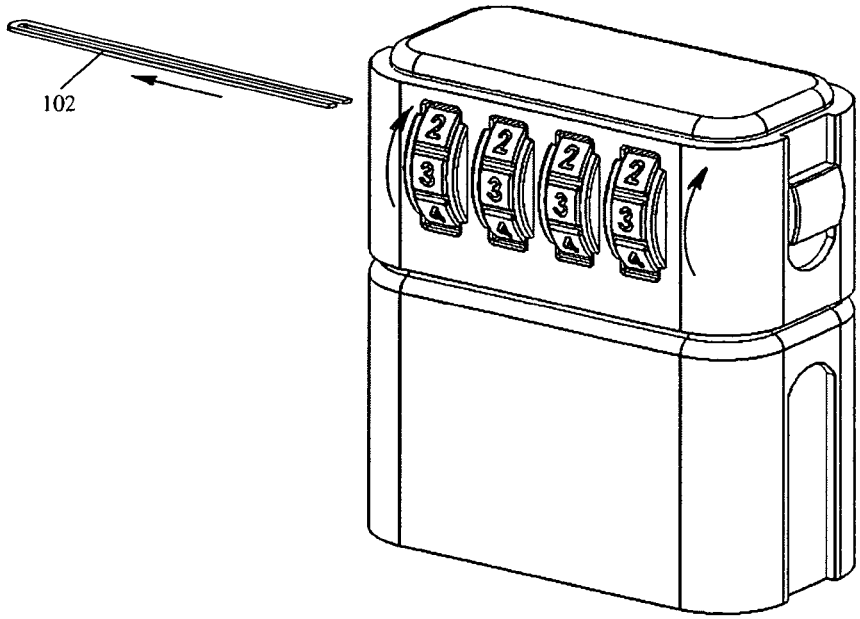
FIG. 9 is front perspective view illustrating the embodiment of the present invention shown in FIG. 1 with the retaining pin being removed.

In order to use the locking pill bottle 10 a user, such as a pharmacist or a consumer, typically first receives the locking pill bottle 10 with the inner rings 112 of the combination wheels 88-94 held in their unset positions by the retaining pin 102 as described above. The user then sets a combination for the integrated lock 16 by manually engaging the portion of each of the outer rings 114 of the combination wheels 88-94 that protrude through the wheel apertures 46-52 of the cap 14, such as with a thumb or a forefinger, and rotating the outer rings 114 relative to the inner rings 112 (in the manner described above) by pushing upwardly or downwardly until the indicia 116 representing a desired four digit combination are longitudinally aligned at the 9 o'clock positions of their respective combination wheels 88-94. With the selected indicia 116 positioned thusly, a groove 118 of each outer ring 114 is at the 12 o'clock position by virtue of the 90 degree separation between each indicia 116 and a groove 118 (described above). Next, the user withdraws the retaining pin 102 from the cap 14 through the pin aperture 56 as shown in FIG. 9, thereby allowing each of the inner rings 112 to expand to their set positions (as described above) with the tooth 136 of each inner ring 112 moving into radial engagement with a groove 120 in its respective outer ring 114 as best shown in FIG. 8. Thereafter, the rotational movement of each outer ring 114 is locked to the rotational movement of its respective inner ring 112, and the lobe portion 130 of the key channel 124 of each inner ring 112 will be in the 6 o'clock position, and thus longitudinally aligned with an adjacent key lobe 166-172 of the key shaft, only when the correct indicium (as set by the user in the manner described above) on the corresponding outer ring 114 is at the 9 o'clock position.

After setting the combination in the manner described above, the user then preferably rotates at least one of the combination wheels 88-94 until the correct indicium on the combination wheel 88-94 is moved out of the 9 o'clock position. Positioned thusly, the lobe portion 130 of the inner ring 112 of the rotated combination wheel 88-94 is longitudinally misaligned with the adjacent key lobe 166-172 of the key shaft 160. If a user subsequently pushes the primary catch button 180, the misaligned key lobe 166-172 will longitudinally engage the periphery of the rotated key channel 124 (as opposed to moving longitudinally into the lobe portion 130 of the key channel 124). This prevents the key lobe 166-172 from moving longitudinally-rearward, beyond the forward-most edge of the key channel 124, which in-turn prevents the drive bar 96 from being longitudinally moved to the unlocked position. Those who do not know the correct combination for the lock 16 are thus prevented from opening the locking pill bottle 10 through use of the primary catch button 180, or at least the likelihood of such a person being able to open the locking pill bottle 10 without inflicting evident damage to the locking pill bottle 10 is greatly reduced.

In order to open the locking pill bottle 10, a user with knowledge of the correct combination rotates the combination wheels 88-94 until the correct indicium on each wheel 88-94 palpably "clicks" into place (see the description of the detent arm 111 above) at the 9 o'clock position. With the combination wheels 88-94 positioned thusly, the lobe portions 130 of the key channels 124 of the inner rings 112 are longitudinally aligned with the key lobes 166-172 of the key shaft 160. If a user subsequently pushes the primary catch button 180 with a sufficient amount of force to overcome the resistance of the spring 100, each key lobe 166-172 will move longitudinally-rearward, into the lobe portion 130 of an adjacent key channel 124, and the drive bar 96 will thereby be moved to the unlocked position. While keeping the primary catch button 180 depressed, the user can lift the front side of the cap 14 away from the receptacle 12 and thereby gain access to the contents of the receptacle 12.

The correct combination for the lock 16 of the locking pill bottle 10 is preferably known only to the user who set the combination. If the user forgets the combination after setting it, the locking pill bottle 10 can be opened by inserting a narrow implement through the defeat aperture 56 in the cap 14 and manipulating the defeat mechanism 66 in the manner described above. The existence and method of operating the defeat mechanism 66 are preferably kept secret from all but the manufacturer and the users of the locking pill bottle 10. Although it is preferred that the locking pill bottle 10 be provided with a means for circumventing the key mechanism 64 to open the locking pill bottle 10, it is contemplated that the defeat mechanism 66 can be omitted.

Figure 12:
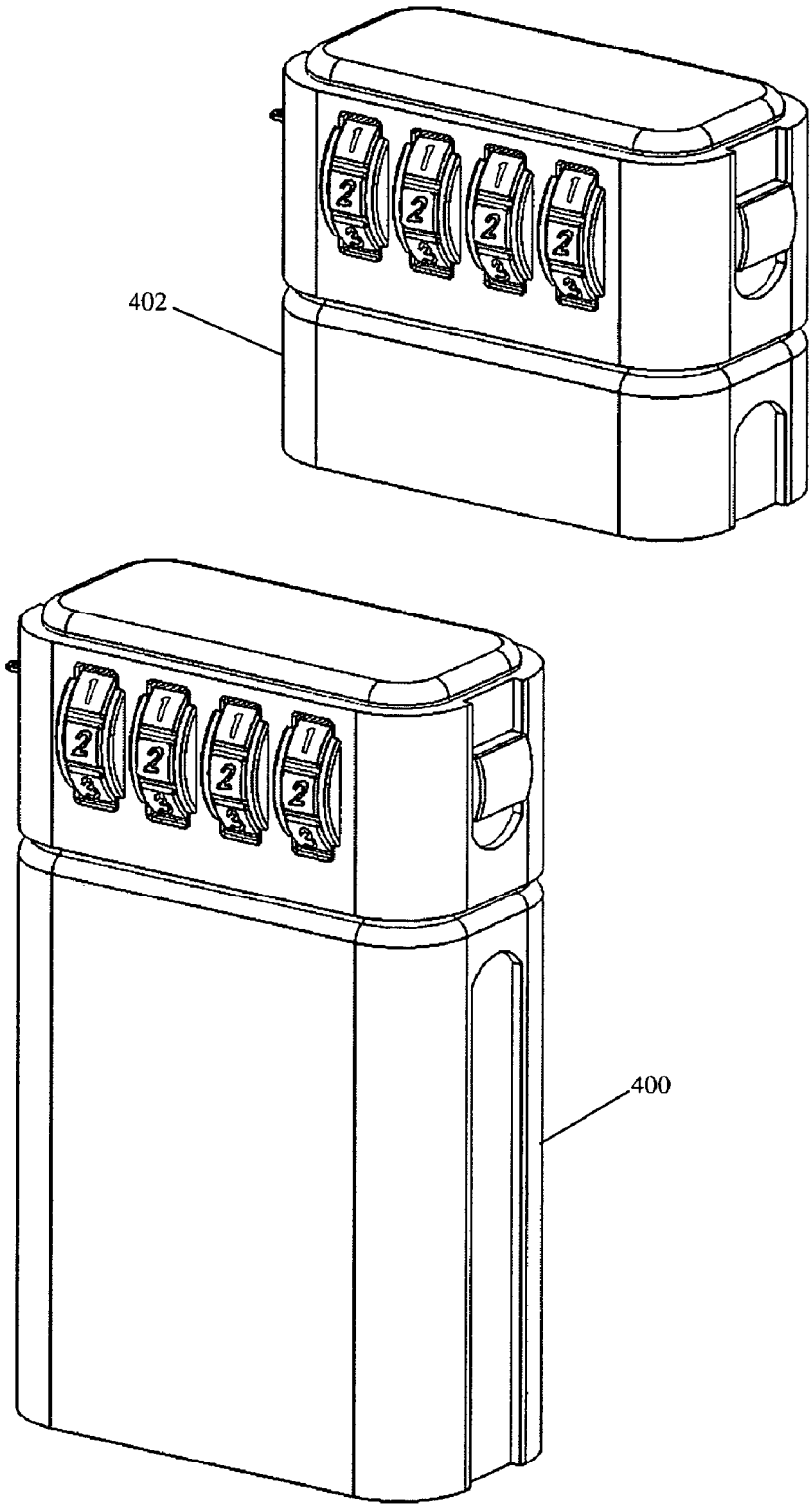
FIG. 12 is a front perspective view illustrating two alternative embodiments of the present invention with receptacles of smaller and larger volumes.

The receptacle 12 of the locking pill bottle 10 has an interior volume of 30 drams, although it is contemplated that receptacles having smaller or larger interior volumes can alternatively be used. It is preferred that only the height of such receptacles be varied to achieve smaller or larger interior volumes, and that the length and width of such receptacles remain consistent, regardless of the receptacles' interior volume, for allowing a single size of cap 14 to fit over receptacles of any volume. For example, referring to FIG. 12, it is contemplated that the locking pill bottle can have a taller, 60 dram receptacle 400, or a shorter, 15 dram receptacle 402, each receptacle having a length and a width that are substantially equal to those of the 30 dram receptacle 12 described above. The precise volume each receptacle can hold is not critical, and the larger and smaller receptacles are described for the purpose of showing that alternative receptacle sizes are contemplated.

Referring to FIGS. 1 and 2, it is preferred that the top wall 42 of the cap 14 of the locking pill bottle 10 be formed with a raised crown 230, and that the bottom surface of the floor (not shown) of the receptacle 12 of the locking pill bottle 10 have a corresponding recess formed therein that is of similar size and shape to the crown 230. A plurality of locking pill bottles similar to the locking pill bottle 10 can thereby be stacked one atop another, such as in a medicine cabinet, with the recess and crown of each vertically adjacent pair of bottles in mating engagement with one another. Stacked thusly, the likelihood of the bottles being shifted laterally relative to one another and thereby being caused to fall over is mitigated.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A tamper-resistant container comprising:

(a) a receptacle having an opening;

(b) a cap for fitting over the opening of the receptacle; and (c) a combination lock integral with the cap for locking the cap to the receptacle comprising:

(i) a plurality of combination wheels that protrude through the cap, each combination wheel having:

a. a cylindrical outer ring with an outer surface and an inner surface, the outer surface having a plurality of circumferentially spaced combination indicia and the inner surface having a plurality of circumferentially spaced grooves; and b. an inner ring having at least one tooth extending radially outwardly therefrom and a key channel having a shaft portion and a lobe portion extending axially therethrough, said at least one tooth being radially movable between a retracted position, in which said at least one tooth does not engage a groove of the outer ring for allowing the outer ring to be rotated relative to the inner ring, and an extended position in which said at least one tooth can engage a groove of the outer ring for preventing the outer ring from being rotated relative to the inner ring;

(ii) a primary catch that is movable between a locked position in which the primary catch holds the cap to the receptacle and an unlocked position in which the primary catch does not hold the cap to the receptacle; and (iii) a key shaft connected to the primary catch and extending through the shaft portions of the inner rings of said plurality of combination wheels, said plurality of combination wheels being rotatably movable about an axis of the key shaft, the key shaft having a plurality of key lobes extending therefrom wherein said plurality of key lobes can be shifted into the lobe portions of the key channels of the inner rings for moving the primary catch from the locked position to the unlocked position when each of said plurality of key lobes is aligned with a lobe portion of one of the key channels and wherein said plurality of key lobes are prevented from being shifted into the lobe portions of the key channels of the inner rings for moving the primary catch from the locked position to the unlocked position when at least one of said plurality of key lobes is not aligned with a lobe portion of one of the key channels.

2. The tamper-resistant container in accordance with claim 1, further comprising:

(a) means for biasing the teeth of the inner rings of said plurality of combinations wheels toward the extended position; and (b) an elongated retaining pin extending through the inner rings and releasably holding the teeth in the retracted position until a user removes the retaining pin.

3. The tamper-resistant container in accordance with claim 2, wherein the biasing means comprises at least one flexible serpentine.

4. The tamper-resistant container in accordance with claim 3, wherein said at least one flexible serpentine is integral with an inner ring.

5. The tamper-resistant container in accordance with claim 2, wherein the retaining pin protrudes through the cap.

6. The tamper-resistant container in accordance with claim 1, further comprising a primary catch button that is mounted to the key shaft and protrudes through the cap.

7. The tamper-resistant container in accordance with claim 1, further comprising means for biasing the primary catch toward the locked position.

8. The tamper-resistant container in accordance with claim 7, wherein the biasing means comprises a coil spring.

9. The tamper-resistant container in accordance with claim 1, further comprising a defeat mechanism integral with the cap having a defeat catch that is movable between a locked position in which the defeat catch holds the cap to the receptacle and an unlocked position in which the defeat catch does not hold the cap to the receptacle.

10. The tamper-resistant container in accordance with claim 9, further comprising means for biasing the defeat catch toward the locked position.

11. The tamper-resistant container in accordance with claim 10, wherein the biasing means comprises at least one serpentine.

12. The tamper-resistant container in accordance with claim 9, further comprising a defeat aperture formed in the cap for allowing the insertion of an implement to manipulate the defeat mechanism and manually move the defeat catch from the locked position to the unlocked position.

13. The tamper-resistant container in accordance with claim 12, wherein the implement comprises a proprietary key.

14. The tamper-resistant container in accordance with claim 1, further comprising a plurality of circumferentially spaced grooves in the outer surface of at least one of said outer rings for receiving a detent arm held in engagement with said at least one outer ring and configured to engage one of said plurality of circumferentially spaced grooves for providing a user with a perceptible sensation when rotating said at least one outer ring.

15. A method for setting a combination of a combination lock having a plurality of combination wheels, each wheel including a cylindrical outer ring having an outer surface and an inner surface, the outer surface having a plurality of circumferentially spaced combination indicia and the inner surface having a plurality of circumferentially spaced grooves, an inner ring located radially within the outer ring having at least one tooth extending radially outwardly therefrom and a key channel extending axially therethrough having a shaft portion and a lobe portion, said at least one tooth being radially movable between a retracted position in which said at least one tooth cannot engage a groove of the outer ring for allowing the outer ring to be rotated relative to the inner ring and an extended position in which said at least one tooth engages a groove of the outer ring for preventing the outer ring from being rotated relative to the inner ring, the tooth of each inner ring being biased toward the extended position by a biasing means, the combination lock further including a removable, elongated retaining pin extending through the inner rings and holding each tooth in the retracted position, the method comprising:

(a) rotating each of the outer rings of the combination wheels relative to the inner rings until a desired indicium on each outer ring is positioned at a designated circumferential position; and (b) removing the retaining pin from the inner rings to allow the teeth of the inner rings to be moved into radial engagement with the grooves of the outer rings by the biasing means.

* * * * *